US006144250A

United States Patent [19]

Owen et al.

[11] Patent Number: 6,144,250

[45] Date of Patent: Nov. 7, 2000

[54] ERROR AMPLIFIER REFERENCE CIRCUIT

[75] Inventors: Richard T. Owen, Fremont; Dennis P. O'Neill, Monte Sereno, both of Calif.

[73] Assignee: Linear Technology Corporation, Milpitas, Calif.

[21] Appl. No.: 09/239,047

[22] Filed: Jan. 27, 1999

[51] Int. Cl.[7] ..... G05F 1/10; G05F 3/16

[52] U.S. Cl. ..... 327/539; 327/540; 327/313; 327/315

[58] Field of Search ..... 327/538, 539, 327/540; 323/312, 313, 314, 315

[56] References Cited

U.S. PATENT DOCUMENTS

| | | | |
|---|---|---|---|
| 3,617,859 | 11/1971 | Dobkin et al. | 323/313 |
| 4,352,056 | 9/1982 | Cave et al. | 323/314 |
| 4,789,819 | 12/1988 | Nelson | 323/314 |
| 4,816,742 | 3/1989 | Van De Plassche | 323/314 |
| 5,274,323 | 12/1993 | Dobkin et al. | 323/280 |
| 5,339,020 | 8/1994 | Siligoni et al. | 323/313 |
| 5,430,367 | 7/1995 | Whitlock et al. | 323/313 |
| 5,532,579 | 7/1996 | Park | 323/314 |
| 5,926,062 | 7/1999 | Kuroda | 327/538 |

*Primary Examiner*—Timothy P. Callahan
*Assistant Examiner*—Terry L. Englund
*Attorney, Agent, or Firm*—Fish & Neave; Robert W. Morris; Joel Weiss

[57] ABSTRACT

An error amplifier circuit is provided having a pair of current mirror transistors driven by a pair of current sources, where one of the current mirror transistors operates at a lower current density than the other, and further having a resistor in an emitter circuit of the transistor operating at the lower current density and a summing node in the emitter circuit between the emitter of the one transistor and the resistor. A feedback circuit including a second resistor and a base-emitter circuit of a third transistor is in series between a feedback node coupled to the base of the feedback transistor and the summing node, such that a current from the feedback circuit is summed with the current conducted by the emitter of the one transistor. The error amplifier is balanced when the voltage at the feedback node is equal to a predetermined voltage, which can have substantially zero temperature coefficient at a voltage as low as one bandgap voltage. A resistive divider may be coupled to the feedback node, such that the error amplifier is balanced when the voltage at a node of the resistive divider is at a predetermined voltage greater than the bandgap voltage. The error amplifier may be used, among other applications, as a control circuit for a low dropout voltage regulator which is capable of producing a regulated output voltage, having nominally zero temperature drift over a wide operating range, substantially equal to or greater than the bandgap voltage.

17 Claims, 3 Drawing Sheets

200
Vin
240
Vout
231
$V_{BG}$
232
1.22V
211
233
226
95K
260
Cnoise
0.65V
5uA
212
72mV
225
12K
270
1.2uA
205
210
250
235
223
209
204
1.2uA
234
E
12mV
224
10K
GROUND
203
220
230
208
207
222
206
221
202
201
1.2uA
21

300
Vin
240
205
204
203
202
201
220
21
Vout
231
$V_{BG}$
232
233
211
226
260
Cnoise
225
270
310
250
235
223
309
312
224
234
E
GROUND
208
230

ERROR AMPLIFIER REFERENCE CIRCUIT

This invention relates to error amplifier circuits found in many different types of control circuits. More particularly, the present invention relates to an error amplifier circuit which enables low dropout voltage regulators to produce temperature-compensated, regulated output voltages at least as low as about one bandgap voltage.

BACKGROUND OF THE INVENTION

The purpose of a low dropout voltage regulator is to provide a predetermined and substantially constant output voltage to a load, over a wide temperature range, from a voltage source which may be poorly-specified or fluctuating. In typical low dropout regulators, the output voltage is regulated by controlling the current through a pass element (such as a power transistor) from the voltage source to the load.

Typically, low dropout voltage regulators incorporate the following primary elements (in addition to the pass device): (1) drive circuitry for controlling the current conducted by the pass device by adjusting drive to the pass device, (2) control circuitry for generating a reference signal, and for comparing a feedback signal (typically the output voltage or current, or portion thereof) to the reference signal to generate an error signal indicative of the difference between the output and reference; (3) a current source generator for providing currents to the circuits; (4) a bias circuit for biasing the current source generator, and (5) a startup circuit. The error signal generated by the control circuitry is coupled to the drive circuitry, in order to raise or lower as appropriate the drive current delivered to the pass device based on the feedback signal as compared to the reference signal. Raising or lowering the drive current adjusts the current delivered to the load and, consequently, regulates the output voltage to a desired value.

Low dropout voltage regulators are known in the prior art. While these circuits work well, they typically are unable to produce regulated output voltages lower than about 2.5 volts. An example of such a prior art low dropout regulator is disclosed in Dobkin et al. U.S. Pat. No. 5,274,323. A simplified block and circuit diagram of that prior art circuit is illustrated in FIG. 1.

The prior art circuit architecture of FIG. 1 forms a low dropout voltage regulator 100 capable of producing temperature compensated, regulated output voltages at output terminal 105 ($V_{OUT}$) from about 2.5 volts to 15 volts. The circuit components within block 180 form a control circuit which includes a combined reference voltage generator and error amplifier circuit. The circuitry in block 180 produces an output error signal at node 165 as a function of the output (feedback) voltage developed at terminal 105. The error signal is coupled to current drive circuit 104, which in turn drives pass device 150 of voltage regulator 100. The components within block 160 form an impedance string to temperature compensate the control circuitry, to obtain a desired temperature drift of the control circuitry (typically zero to a first order) over a wide temperature range (typically, −50° C. to 125° C.). The control circuit is powered by current drawn from the output voltage 105, and biased by current source generator 103. Transistors 119 and 120 (and associated resistors 108 and 109) form current sources for a current mirror comprised of transistors 125 and 126. The emitter areas of transistors 125 and 126 are in a ratio of 1:10, respectively.

In operation, as the voltage at output (feedback) terminal 105 begins to rise, the currents flowing through the string of components including transistors 119, 118, 117 and 126, and resistors 109, 113 and 116, and the string comprised of resistor 108, transistor 120 and transistor 125, begin to rise. As the currents increase, the $\Delta V_{BE}$ voltage dropped across resistor 116 (this voltage being created as a consequence of the unequal emitter areas of transistors 125 and 126) causes the current ratio between transistors 125 and 126 to decrease. This causes the collector voltage of transistor 125 (the error signal) to decrease. When the voltage drop across resistor 116 reaches approximately 60 mv, the current ratio between the two transistors reaches 1:1. This is the stable operating point of the circuit at which the output voltage will be regulated. In the circuit of FIG. 1, the output voltage at terminal 105 will be regulated to 5 volts. If the output voltage tends to rise above 5 volts, additional current will flow through resistor 116 causing the voltage across the resistor to increase. This unbalances the circuit, causing the current ratio between transistors 125 and 126 to decrease and, hence, error signal at node 165 also to decrease. This causes drive circuit 104 to reduce the drive to pass device 150, which causes control circuit 180 to sink less current from the output terminal and the output voltage to decrease back towards the regulated point. On the other hand, if the output voltage tends to fall below the regulating point, the error signal 165 increases. This causes drive circuit 104 to increase the drive to pass device 150, thus causing the output voltage to increase towards the regulated voltage. Further details about the operation of the circuit of FIG. 1 are set forth in U.S. Pat. No. 5,274,323, the disclosure of which is incorporated herein by reference.

As stated above, the circuit of FIG. 1 patent is unable to produce a regulated output voltage having substantially zero temperature drift (to a first order) of less than about 2.5 volts. This minimum regulated output voltage results from the topology of circuit 180. Although impedance circuit 160 can be simply a resistor or combination of resistors, transistors and diodes or the like, chosen so that the output drop across it produces the proper desired regulation voltage, the circuit of FIG. 1 still requires at least two base-emitter junctions (of transistors 119 and 126) to be in series within the feedback loop of the control circuit between the feedback terminal and GROUND. Temperature compensation of these two transistors to cause a substantially zero temperature drift of the regulated output voltage (e.g., by appropriate choice of the temperature drift of the biasing currents produced by current source generator 103) requires that the feedback voltage (and, hence, the minimum output voltage) be set to a minimum of about twice the bandgap voltage (i.e., about 2.5 volts).

Accordingly, it would be desirable to provide an error amplifier for a control circuit that utilizes an efficient topology for the combination of a feedback input circuit and an error amplifier.

It would further be desirable to provide an error amplifier for a low dropout voltage regulator control circuit that enables the low dropout regulator to produce a regulated output voltage having a substantially zero temperature drift (first order) substantially below 2.5 volts.

SUMMARY OF THE INVENTION

It is therefore an object of this invention to provide an error amplifier for a control circuit that utilizes an efficient topology for the combination of a feedback input circuit and an error amplifier.

It is yet another object of this invention to provide an error amplifier for a low dropout voltage regulator control circuit that enables the low dropout regulator to produce a temperature-compensated regulated output voltage substantially below 2.5 volts.

These and other objects of the invention are accomplished by an error amplifier circuit which includes current sources driving a current mirror for generating a reference voltage across a resistor in the emitter circuit of one of the current mirror transistors, and a feedback circuit for coupling a feedback signal to the current mirror such that a feedback current conducted by the feedback circuit is summed into an emitter circuit of the current mirror transistors. The feedback circuit preferably includes a feedback transistor having a base coupled to the feedback node, and an emitter coupled through a feedback resistor to one of the current mirror emitter circuits. Substantially zero temperature drift (to a first order) may be achieved by choosing a value of the feedback resistor so that the base of the feedback transistor may be at the bandgap voltage (approximately 1.22 volts) when the error amplifier is balanced. The error amplifier of the present invention thus is able to control a low dropout voltage regulator for producing regulated output voltages as low as 1.22 volts. A resistive divider string having an intermediate node coupled to the feedback node may be used to set the regulated voltage at the top of the string to a desired value proportional to and greater than the voltage at the feedback node.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 2:
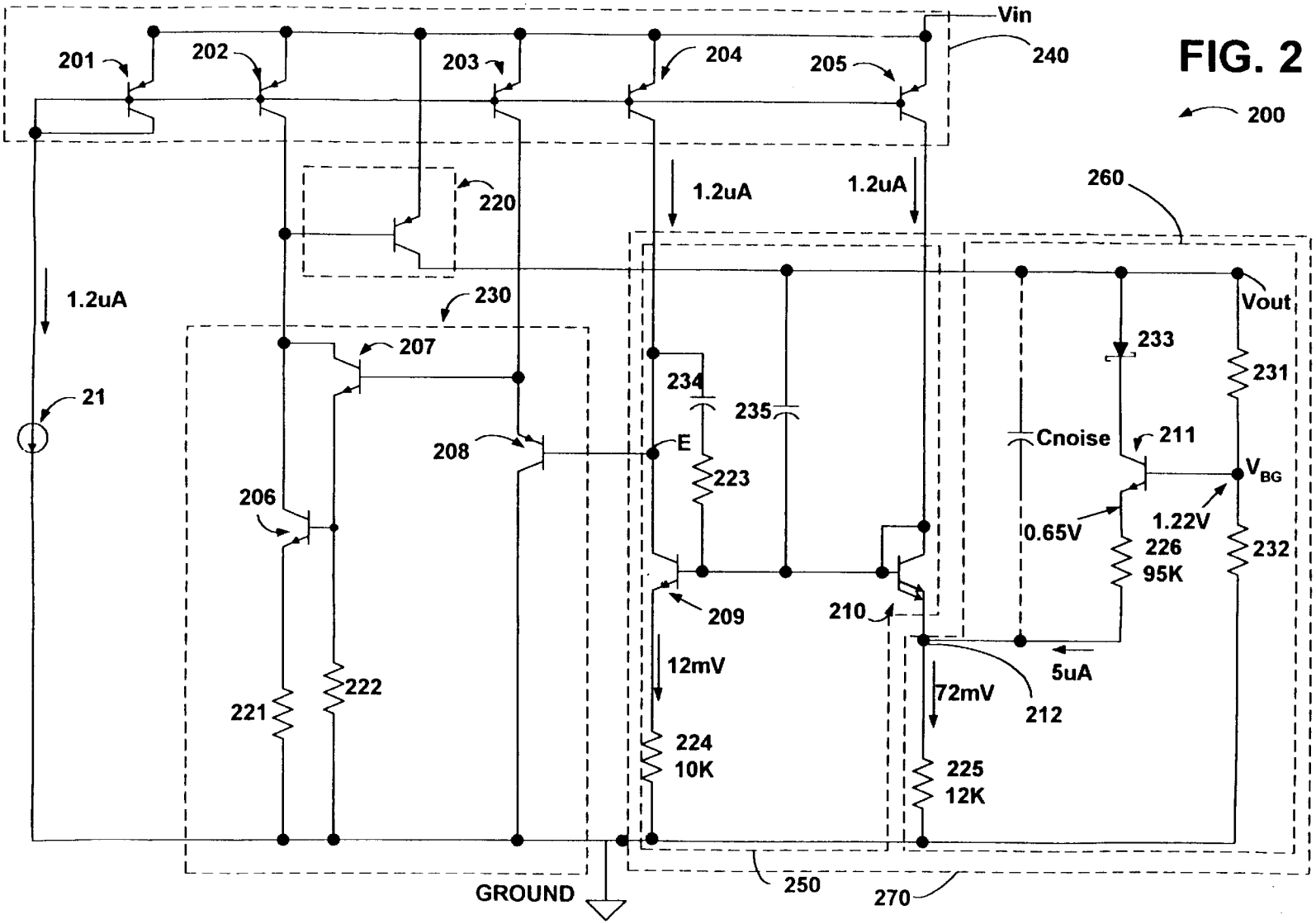
FIG. 2 is a circuit diagram of a first embodiment of an error amplifier circuit according to the principles of the invention, in the context of a low dropout voltage regulator.
Figure 3:
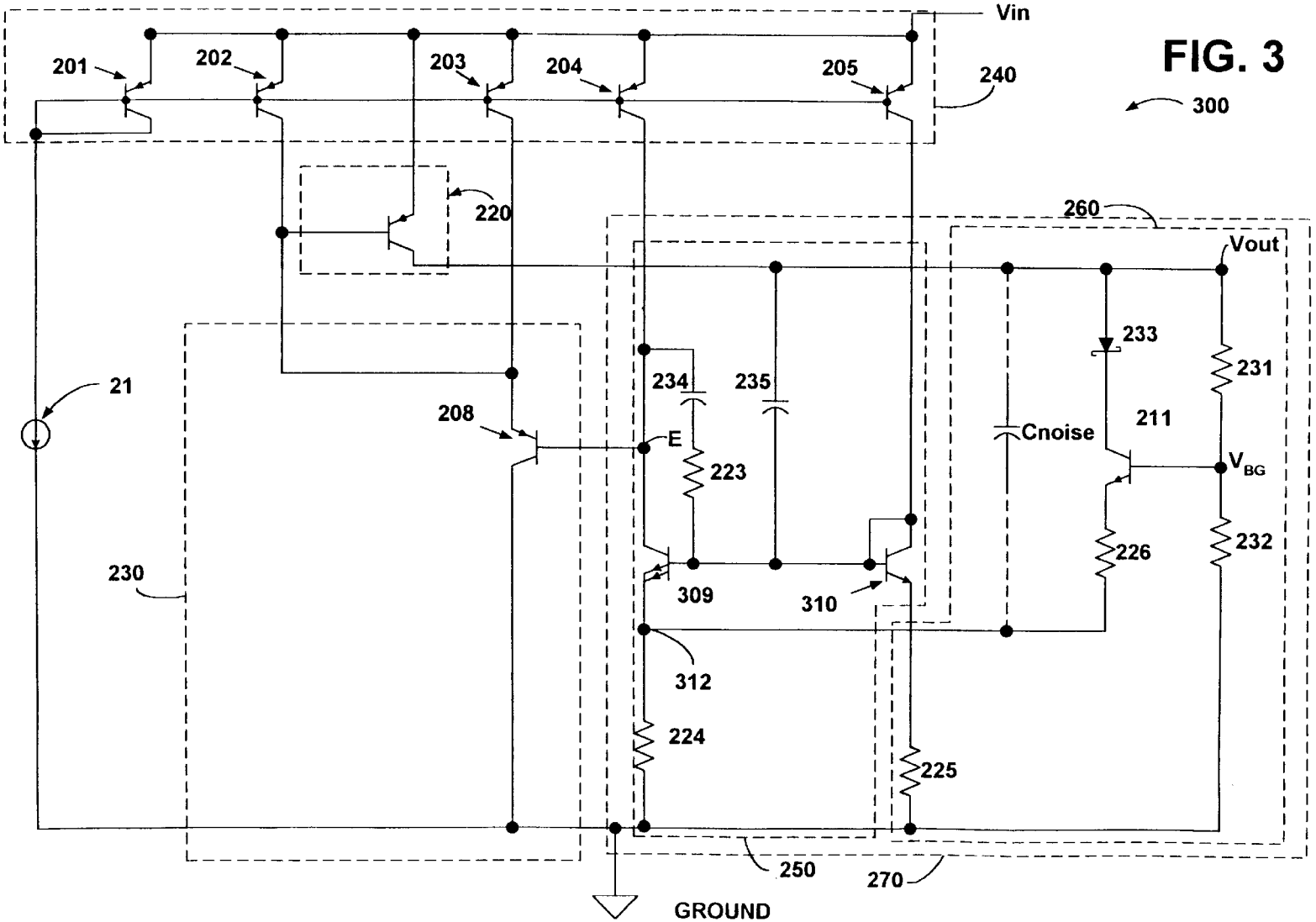
FIG. 3 is a circuit diagram of a second embodiment of an error amplifier circuit according to the principles of the invention, in the context of a low dropout voltage regulator.

FIG. 2 illustrates a first embodiment of the error amplifier circuit of the present invention, in the context of a low dropout voltage regulator circuit 200. Regulator 200 is coupled to a source of input voltage appearing across terminals $V_{IN}$ and GROUND, and produces a regulated output voltage (relative to GROUND) at terminal $V_{OUT}$. The regulator includes a pass device (power transistor) 220 for conducting current from $V_{IN}$ to $V_{OUT}$ (where a regulated output voltage is generated), a drive circuit 230 coupled to the pass device, a current source generator 240, a bias generator 21, and a control circuit 270. Bias generator circuitry 21, which preferably includes a start-up circuit, generates a current which is substantially proportional to absolute temperature ($I_{PTAT}$). An example of a circuit suitable for implementing bias generator 21, including a suitable startup circuit, is shown in FIG. 3 of U.S. Pat. No. 5,274,323 (transistors Q5, Q6 and Q7, resistor R1 and capacitor C1, and startup circuit transistors Q1, Q2, Q3 and Q4A, and resistors R2 and R3). Suitable bias and startup circuit circuitry also is shown in co-pending commonly assigned U.S. patent application Ser. No. 09/239,048, entitled "Current General Circuitry with Zero Current Shutdown State," filed on even date herewith (the disclosure of which is incorporated herein by reference). Alternatively, as will be appreciated by persons skilled in the art, any of a number of other (conventional) biasing and startup circuits could be used. Current source generator 240 comprises parallel-connected transistors 201–205, and produces the currents required by the other circuitry of the voltage regulator. Transistor 201 is for biasing current source generator 240, which draws on the input voltage to provide currents for the circuit to operate. Pass transistor 220 controllably conducts current from input node $V_{IN}$ to output node $V_{OUT}$. Pass transistor 220 and, hence, the regulated voltage at $V_{OUT}$, is controlled by driver circuit 230 comprising Darlington-connected NPN transistors 206 and 207, PNP transistor 208 and resistors 221 and 222. The amount of drive provided to pass transistor 220 by driver circuit 230 is controlled by the magnitude of an error signal developed at output node E by control circuit 270.

Control circuit 270 includes an error amplifier having a current mirror 250 including transistors 209 and 210 having emitter areas preferably in a ratio of 1:10. The emitters of these transistors are coupled in common, through respective resistors 224 and 225 in the transistors' emitter circuits, to GROUND. The current mirror is driven by current source transistors 204 and 205. Resistor 223 and capacitors 234 and 235 provide high-frequency compensation for the error amplifier. Control circuit 270 also includes a feedback circuit within circuit block 260, comprised of the base-emitter circuit of transistor 211 in series with resistor 226 coupled between feedback node $V_{BG}$ and emitter node 212 of current mirror transistor 210. The collector of transistor 211 is coupled to $V_{OUT}$ through Schottky diode 233. The Schottky diode is used to provide negative output voltage protection, and is not critical to the operation of the circuit. Finally, circuit block 260 includes resistors 232 and 231 coupled as a voltage divider string to $V_{OUT}$ and GROUND, and to the base of feedback transistor 211 at an intermediate node of the divider string labeled $V_{BG}$. As more fully discussed below, this divider string may be used to set the regulated voltage at terminal $V_{OUT}$.

The circuit of FIG. 2 operates as follows. Transistors 204 and 205 are a matched pair of current sources, which source equal currents to the two legs of the error amplifier/current mirror formed by transistors 209 and 210. When the currents conducted by transistors 209 and 210 are equal to each other, and to the currents sourced by transistors 204 and 205, the error amplifier is balanced. When the error amplifier is balanced, the $V_{BE}$ of transistor 210 will be 60 mv less than that of transistor 209 at 25° C. and the voltage dropped across reference resistor 225 will be a $\Delta V_{BE}$ voltage of 60 mv greater than that dropped across resistor 224. In operation, when the circuit first turns on, the error signal at node E drives emitter-follower transistor 208 of drive circuit 230, which drives Darlington-connected transistors 206 and 207, which in turn drive pass transistor 220 to conduct current from $V_{IN}$ to $V_{OUT}$. As more current is conducted by pass transistor 220, the voltage at $V_{OUT}$ begins to rise. AS $V_{OUT}$ rises, so does the voltage at $V_{BG}$ (as dictated by resistive divider 231 and 232). AS $V_{BG}$ rises, transistor 211 begins to turn on and conduct a feedback current from $V_{OUT}$ through resistor 226 to summing node 212 at the emitter of transistor 210 of current mirror 250. The additional feedback current into resistor 225 causes its voltage to rise, which causes the base of transistor 210 also to rise. This raises the voltage at the base of transistor 209, turning that transistor on harder. The feedback loop will drive pass transistor 220 until the voltage at $V_{OUT}$ rises enough to cause feedback current to be summed into resistor 225 to cause the voltage dropped across it to be 60 mv higher than that dropped across resistor 224 (as determined by the 1:10 ratio of the emitter areas of transistors 209 and 210). At this point, the error amplifier is balanced because equal currents are conducted by transistors 209 and 210. The voltage at feedback terminal $V_{BG}$ is at its stable operating point, and the output voltage $V_{OUT}$ is at its regulated value.

If the voltage at $V_{OUT}$ tends to rise above its nominal regulated value, feedback node $V_{BG}$ also rises above its stable operating point. This causes additional feedback current to be summed into node 212. As a result, the voltage across reference resistor 225 rises, which causes transistor 209 to be driven harder and the error signal at node E to drop, which pulls down on the base of emitter follower transistor 208 which reduces the drive to Darlington pair 207/206. This causes the drive to pass transistor 220 to decrease, which reduces the current provided to the output. The output voltage accordingly drops to its regulated value, to return the feedback loop to a balanced state. On the other hand, if the voltage at $V_{OUT}$ tends to drop below its nominal regulated value, the opposite occurs. The pass transistor is driven harder until the output voltage rises to its regulated value, returning the feedback loop to its stable operating point.

The $V_{BE}$ voltage developed across the base-emitter junction of feedback transistor 211, in combination with the voltage dropped across resistor 226, combine with the voltage developed across reference resistor 225 to cause the voltage at node $V_{BG}$ to be substantially equal to the bandgap voltage (approximately 1.22 volts). By selecting a value for resistor 226 so as to set the nominal voltage at $V_{BG}$ to be equal to the bandgap voltage when the error amplifier is balanced, the voltage at feedback node $V_{BG}$ will have a nominally zero temperature drift (to a first order) and, hence, will be reasonably flat over usable operating temperature ranges (typically −50° C. to +125° C.). Because the voltage at $V_{OUT}$ is proportional to the voltage at $V_{BG}$ by virtue of resistive divider 231 and 232, regulated voltage $V_{OUT}$ also will have a nominally zero temperature drift.

Figure 1:
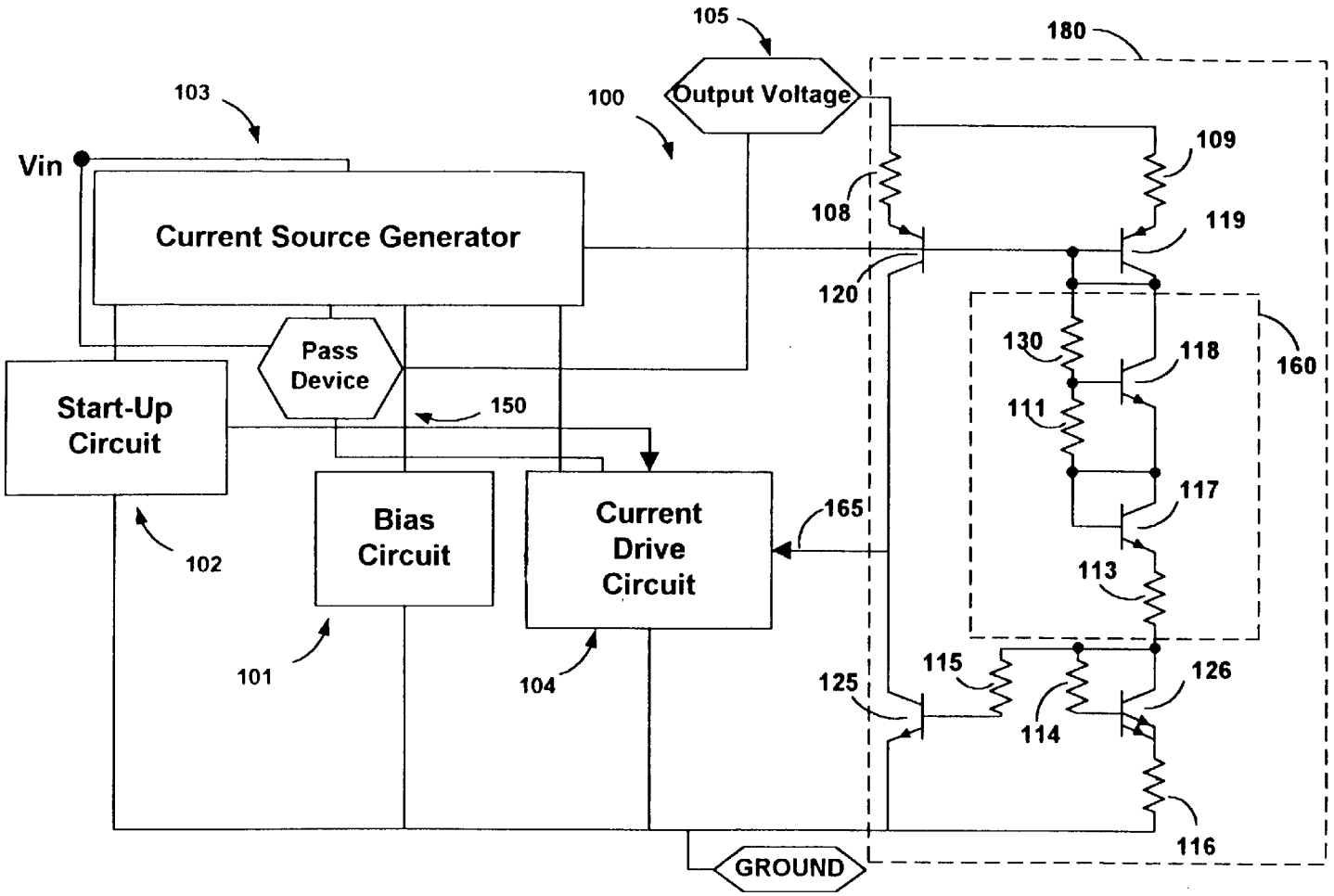
FIG. 1 is a simplified block and circuit diagram of a prior art low dropout voltage regulator circuit.

By summing the feedback current into the error amplifier at a node in the emitter circuit of one of the error amplifier's current mirror transistors, rather than at a collector of those transistors as in the prior art circuit of FIG. 1, the voltage drops across the base-emitter circuits of the mirror transistors and of the current source transistors are not included in the feedback path in the circuit of the present invention. This enables the error amplifier of the invention to operate at a significantly lower feedback voltage, and consequently enables a low dropout voltage regulator to generate temperature compensated, regulated voltages significantly lower than those capable of being generated by the circuit of FIG. 1.

It will, of course, be appreciated by those skilled in the art that ratios other than 1:10 may be used for the emitter areas of transistors 209 and 210. As is well known to persons skilled in the art of integrated circuit design, the difference in base-to-emitter voltage ($\Delta V_{BE}$) of two transistors as a function of their currents and emitter areas may be determined by the following formula:

$$\Delta V_{BE}=(K/q)*Tln(I_{C1}/I_{C2})*(A_{E1}/A_{E2}),$$

where:

K is Boltzman's Constant,

Q is the charge of an electron,

T is temperature in degrees Kelvin, $I_{C1}/I_{C2}$ is the ratio of the collector currents for the two transistors, and $A_{E1}/A_{E2}$ is the ratio of the emitter areas of the two transistors.

FIG. 2 also shows exemplary currents and values associated with particular components in the illustrated embodiment (it will, of course, be appreciated that other currents and component values could be used) . Current sources 204 and 205 provide exemplary PTAT currents of 1.2 $\mu$A, resistor 224 is 10K-ohm, resistor 225 is 12K-ohm, and resistor 226 is 95K-ohm. These values result in 12 mV and 72 mV being nominally dropped across resistors 224 and 225, respectively, and 5 $\mu$A of feedback current being summed into node 212, when the current mirror is balanced with $V_{BG}$ and $V_{OUT}$ at their nominal values. With the specific values shown, the voltage at the base of transistor 211 ($V_{BG}$) can be adjusted down to one bandgap voltage (approximately 1.22 volts), depending on the values chosen for resistive divider string 231 and 232. A regulated output of about 1.22 volts may be attained if the value of resistor 231 is chosen to be at or close to zero, or at least sufficiently small as compared to that of resistor 232 so as to result in the voltage dropped across resistor 231 to be substantially at or close to zero. Other values of resistors 231 and 232 may of course be chosen, so as to set the voltage at $V_{OUT}$ to a desired regulated value. In doing so, the value of resistor 224 should preferably be chosen so as to provide optimal ripple rejection.

FIG. 3 illustrates another embodiment of the present invention. The circuitry of FIG. 3 is the same as that of FIG. 2, except that: (1) the emitter area ratio of transistors 309 and 310 has been reversed as compared to that of transistors 209 and 210, so that the emitter area of transistor 309 is 10 times that of transistor 310 as shown; (2) the feedback current is summed into the current mirror at summing node 312 at the emitter of 10× transistor 309, and (3) Darlington transistors 206 and 207, and emitter resistors 221 and 222, have been removed so that emitter-follower transistor 208 now directly drives pass transistor 220. The Darlington is no longer needed because summing the feedback current into the side of the current mirror where the error signal is produced at node E reverses the phase of the circuitry of FIG. 3 as compared to what it was in FIG. 2. The error signal thus reacts oppositely in FIG. 3 to changes in $V_{OUT}$ and $V_{BG}$, as compared to FIG. 2.

It will be appreciated by persons skilled in the art that other modifications may be made to the circuitry of the illustrated embodiments, without departing from the spirit and scope of the present invention. For example, the circuit of FIG. 2 could be arranged such that the PNP current sources (transistors 205 and 204) provide equal currents to the current mirror, the current mirror transistors 209 and 210 have ratioed emitter areas, and emitter resistors 224 and 225 are made equal. This arrangement rejects variations in the PNP currents, such that even with such variations the feedback voltage at node $V_{BG}$ remains at one bandgap. Alternatively, the PNP transistors could provide equal currents, the emitter areas could be made equal, and unequal current emitter resistors could be used in the current mirror. Such a circuit produces a substantially zero $\Delta V_{BE}$ voltage across the error amplifier emitter resistors. In this case, the temperature drift of the circuit may be compensated for by controlling the temperature coefficient of the PNP currents to have a positive temperature coefficient other than PTAT. And in still another modification, the currents provided by the current sources are ratioed, and the emitter areas of the current mirror transistors are substantially equal. Because the current densities of the two current mirror transistors are different, a $\Delta V_{BE}$ voltage would appear across a reference resistor in the emitter circuit conducting the lower current. The error amplifier would be balanced when the currents conducted by the current mirror transistors are in the ratio and substantially equal to the currents produced by the current sources. Furthermore, the feedback circuit may be connected to a node in the emitter circuit of one of the current mirror transistors other than directly at the emitter of the one transistor. For instance, resistor 225 could be comprised of two resistors in series, and the feedback node could be at a node intermediate between the two resistors. Still other modifications may be made, such as coupling the collector of transistor 211 to other than $V_{OUT}$ and/or current source 240 to other than $V_{IN}$. And an optional capacitor $C_{NOISE}$ may be added from $V_{OUT}$ to node 212 as shown. Addition of this capacitor bypasses the reference and lowers the output voltage noise. This capacitor may also improve the transient response of the circuit. These characteristics are often desired for certain applications such as cellular telephones.

Thus, a novel error amplifier circuit has been disclosed. Persons skilled in the art will appreciate that the present invention can be practiced by other than the described embodiments, which are presented for purposes of illustration and not of limitation, and the present invention is limited only by the claims which follow.

What is claimed is:

1. An error amplifier circuit for use in a control circuit, said error amplifier circuit comprising:

a first current source and a second current source;

a current mirror having a first current mirror transistor coupled to said first current source, a second current mirror transistor coupled to said second current source, a first resistor coupled in an emitter circuit of one of said current mirror transistors to define a summing node in said emitter circuit between the first resistor and the emitter of said one transistor, wherein said current mirror transistors run at different current densities and said current mirror produces an output signal for driving additional circuits;

a second resistor; and a third transistor having a collector, an emitter and a base; wherein said second resistor and a base-emitter circuit of said third transistor are in series between a feedback node coupled to the base of said third transistor and said summing node, and the collector of said third transistor is coupled to a source of voltage, such that the value of said output signal is determined by the value of a feedback voltage established at said feedback node.

2. The error amplifier circuit of claim 1, wherein said error amplifier is balanced when the voltage at the feedback node is a predetermined voltage.

3. The error amplifier circuit of claim 2, wherein said predetermined voltage is substantially equal to one bandgap voltage.

4. The error amplifier circuit of claim 1, further comprising:

a divider network having first and second nodes and an intermediate node, wherein said intermediate node is coupled to the feedback node such that the error amplifier is balanced when the voltage at one of said first and second nodes is equal to a predetermined voltage greater than and proportional to the voltage at said feedback node.

5. The error amplifier circuit of claim 1, wherein said first and second current sources generate substantially equal currents and the emitter areas of said first and second current mirror transistors are different.

6. The error amplifier circuit of claim 1, wherein the emitter areas of said first and second current mirror transistors are substantially equal, and said first and second current sources generate different currents.

7. The error amplifier circuit of claim 1, wherein said one current mirror transistor runs at a lower current density than the other current mirror transistor.

8. The error amplifier circuit of claim 1, further including:

a pass transistor having a collector-emitter circuit coupled to conduct a current from an input terminal to an output terminal, and a base; and a driver circuit having an output coupled to the base of said pass transistor for controlling the current conducted by said pass transistor, and an input coupled to receive the output signal from said error amplifier; wherein said output terminal is coupled to said feedback node such that the voltage at said output terminal is regulated to a predetermined value equal to or greater than the voltage at said feedback terminal.

9. The circuit of claim 8, further comprising:

a divider network having first and second nodes and an intermediate node, with said intermediate node coupled to said feedback node and one of said first and second nodes coupled to said output terminal, such that the voltage at the output terminal is greater than and proportional to the voltage at said feedback node.

10. The circuit of claims 8 or 9 wherein said current mirror is balanced, and the voltage at the output terminal is at the regulated value, when the voltage at the feedback node is equal to a predetermined voltage.

11. The circuit of claim 10, wherein said predetermined voltage is substantially equal to one bandgap voltage.

12. An error amplifier circuit, comprising:

a current mirror having a first current mirror transistor running at a current density, a second current mirror transistor running at a greater current density, and a first resistor coupled to an emitter circuit of said first current mirror transistor, said current mirror including a first node in the emitter circuit of said first current mirror transistor and a second node for producing an output signal; and a feedback circuit including a second resistor and a base-emitter circuit of a third transistor coupled in series between a feedback node and said first node, and a collector of said third transistor coupled to conduct a feedback current into said first node as a function of a feedback voltage at the feedback node; wherein:

said current mirror is balanced when said feedback current is equal to a predetermined current.

13. The error amplifier circuit of claim 12, wherein:

said feedback current equals said predetermined current when the feedback voltage at said feedback node is equal to a predetermined voltage.

14. The error amplifier of claim 13, wherein said predetermined voltage is substantially equal to one bandgap voltage.

15. A method for producing an error signal at an output of an error amplifier, the error amplifier including first and second current mirror transistors conducting currents provided by respective first and second current sources, the current mirror transistors operating at different current densities, and including a first resistive impedance in an emitter circuit of at least one of the current mirror transistors and a summing node in the emitter circuit located between the emitter of the one current mirror transistor and the first resistive impedance, the first resistive impedance conducting a first current provided by said one current mirror transistor, the method comprising:

conducting a feedback current through a feedback circuit including a resistor coupled in series with a base-emitter circuit of another transistor, the magnitude of the feedback current being a function of the magnitude of a voltage at a feedback node coupled to the base of the another transistor; and coupling said feedback current to said summing node, such that said first resistive impedance conducts a current comprised of the sum of said first current and said feedback current; wherein the value of the error signal is a function of the magnitude of the voltage at the feedback node.

16. The method of claim 15, wherein the error amplifier is balanced and the error signal is at a nominal value when the voltage at the feedback node is at a predetermined voltage.

17. The method of claim 16, wherein the predetermined voltage is substantially equal to one bandgap voltage.

* * * * *